US005469771A

United States Patent [19]

Wasser

[11] Patent Number: 5,469,771

[45] Date of Patent: Nov. 28, 1995

[54] PAD FOR CLOSING A TONE HOLE IN A MUSICAL INSTRUMENT

[75] Inventor: Steven A. Wasser, Wellesley, Mass.

[73] Assignee: Verne Q. Powell Flutes, Waltham, Mass.

[21] Appl. No.: 267,458

[22] Filed: Jun. 28, 1994

[51] Int. Cl.[6] ..... G10D 7/08

[52] U.S. Cl. ..... 84/385 P

[58] Field of Search ..... 84/385 P, 385 R

[56] References Cited

U.S. PATENT DOCUMENTS 4,704,939 11/1987 Straubinger ..... 84/385 P 4,798,122 1/1989 Gisler et al. ..... 84/385 P 4,967,632 11/1990 Etheredge, III et al. ..... 84/385 P

*Primary Examiner*—Steven L. Stephan

*Assistant Examiner*—Cassandra C. Spyrou

*Attorney, Agent, or Firm*—Iandiorio & Teska

[57] ABSTRACT

A pad to be mounted in a cup for closing a tone hole in a musical instrument, includes a rigid back plate having a generally planar base and a central raised collar; and a compliant cushion disposed on the back plate and around the collar and extending laterally at least to the edge of the back plate.

8 Claims, 1 Drawing Sheet

PAD FOR CLOSING A TONE HOLE IN A MUSICAL INSTRUMENT

FIELD OF INVENTION

This invention relates to a pad to be mounted in a cup for closing a tone hole in a musical instrument.

BACKGROUND OF INVENTION

Many musical instruments utilize selective opening and closure of numerous openings in the instrument to change the sound produced by the instrument. Flutes, for example, typically have seventeen or eighteen pads which cover respective tone holes. Accurate and repeatable sealing of the tone holes is essential for producing crisp, clean tones.

The most prevalent pads are a composite of cardboard, wool felt, and a collagen membrane coveting the felt and attached to the cardboard. The pad is secured within a pad cup by a screw and washer or an adhesive. However, a great deal of effort is required to properly align the pad with the rim of the opening over which the pad is positioned. Highly skilled padders utilize paper or plastic shims of about 0.001 to 0.012 inch thick to adjust the alignment of the pad. Alternatively, certain pads can be floated into position on a bed of shellac or other adhesive. Each shimming adjustment requires the removal of the pad from the pad cup to position new shims. Proper padding of the flute often takes several hours to accomplish.

The larger the pad, the more difficult it is to establish a complete seal over the tone hole rim, as the error in pad position becomes magnified as the distance from the center of the pad increases. Because of this, larger pads (usually those 0.600 inch or greater in diameter) are normally held in position in a cup by mechanical means, and then are paper shimmed to adjust their conformity to the tone hole rim.

Various techniques have been developed to accurately and quickly position pads so that they seal over the tone hole rims. However, nearly all these techniques require that the pad be held in position in the flute cup by mechanical means in order to test and shim it. In one approach the pad is momentarily floated and must not be secured mechanically in the cup until after the pad is correctly shimmed. Unfortunately, the mere mechanical securing of the pad in the cup following accurate shimming can alter the relationship of the pad to the tone hole rim and disturb the sealing position of the pad.

In addition, the mechanical securing device contacts the pad on its compliant surface. This compliant surface is normally comprised of wool felt covered by animal membrane. The combination of a compliant pad surface with variability in the amount of torque used on the screw, the position of the washer, the angle of the bushing or other variables can vary the sealing capability of a pad even though the pad itself and the shimming materials behind it remain unchanged. Further, the compression caused in the pad by the mechanical securing device can also cause wrinkles in the membrane coveting the pad which are undesirable from an aesthetic and sealing standpoint.

In those pads which are normally mechanically secured to the cup the pad washer doubles as both a holding device and a resonator. In its function as resonator ,the washer is designed to deflect sound waves back into the flute. The hard surface of the resonator compared to the relatively soft surface of the pad reduces the damping properties of the pad, thereby decreasing energy loss.

SUMMARY OF INVENTION

It is therefore an object of this invention to provide a pad which repeatedly and consistently seals a tone hole or other opening in a musical instrument.

It is a further object of this invention to minimize the amount of positional distortion caused in a pad when it is mechanically secured in a cup or key of a musical instrument.

It is a further object of this invention to minimize the amount of wrinkles caused in a pad when it is mechanically secured in a cup or key of a musical instrument.

It is a further object of this invention to effect its advantages in a manner which is transparent to the installer so as to eliminate any training time required for its use.

It is a further object of this invention to provide an inner positioning ring for the pad cushion to more accurately position and hold the cushion in place.

It is a further object of this invention to provide a "built-in" resonator for those pads which are not mechanically secured.

This invention results from the realization that since the actual surface area of a pad which contacts a tone hole rim is a small percentage of the total pad surface area, and that since the inner area of the pad which normally receives the flange of the bushing or the pad washer is not needed for sealing the tone hole opening, the typically compliant inner portion of the pad can be replaced with a non-compliant material without adversely affecting the ability of the pad to seal the tone hole rim, so that the mechanical securing of the pad can be accomplished against the firm, non-compliant material of the pad without distorting the pad or wrinkling it or the covering membrane.

This invention features a pad to be mounted in a cup for closing a tone hole in a musical instrument. The pad includes a rigid back plate having a generally planar base in a central raised collar, and a compliant cushion disposed on the back plate and around the collar and extending laterally at least to the edge of the back plate.

In a preferred embodiment, the collar may include a clearance hole for mounting the pad to the cup. The pad may include a fastener receivable in the clearance hole. The fastener may include a bushing which extends laterally beyond the collar and engages a portion of the cushion. The pad may include a membrane stretched tautly over the cushion and collar. The pad may be bonded to the cup and the collar may rise axially above the cushion for increasing the tension on the membrane.

DISCLOSURE OF PREFERRED EMBODIMENT

Other objects, features and advantages will occur to those skilled in the art from the following description of a preferred embodiment and the accompanying drawings, in which.

Figure 1:
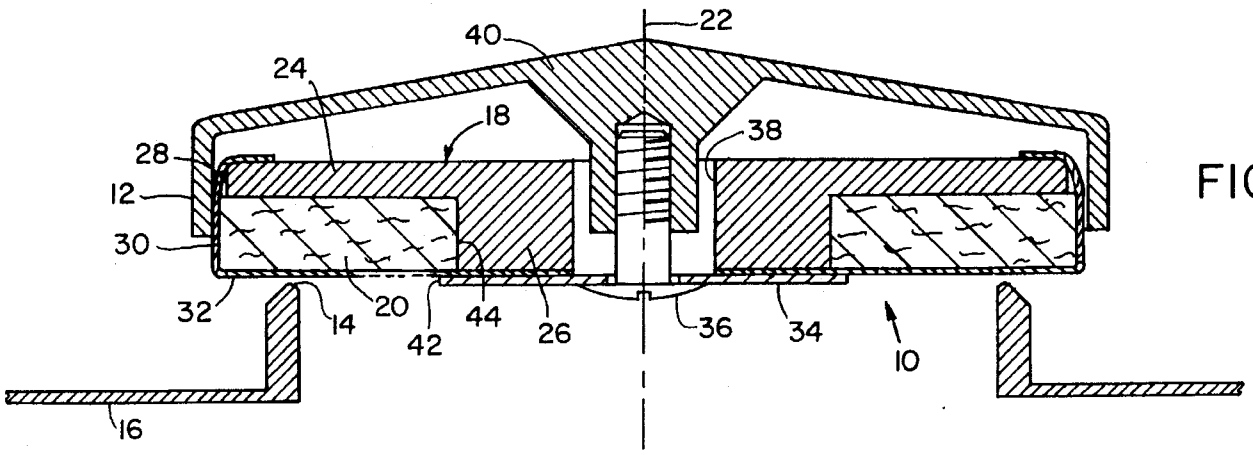
FIG. 1 is a side elevational cross-sectional view of a flute pad according to this invention fastened by a washer or bushing and screw to a spud in a flute cup and positioned over a tone hole.

The invention is accomplished in a pad which has a rigid or non-compliant back plate with an inner or central ring that is stepped on the side facing the tone hole rim. There is a pad cushion positioned around that collar or step ring and supported by the flat or planar area of the back plate. The cushion extends typically at least to the edge of the back plate and may extend somewhat over it. A membrane, often referred to as "fish skin", actually made of animal intestines, is typically wrapped over the cushion and secured to the back of the back plate. If a membrane is not used the cushion is adhered directly to the back plate. Although it has been thought important, there is no rim or ridge at the outer edge of the back plate as taught for example by Straubinger, U.S. Pat. No. 4,704,939, for it has been observed that such a ridge increases the potential for damaging the membrane which is stretched tautly across it. It is also desirable to eliminate that circumferential ridge or rib because it effectively reduces the diameter of the pad since the area it occupies is not available for the cushion material which can engage the tone hole. Thus in close tolerance situations there is less room for variation and proper seating is more difficult. The elimination of this rib or ridge restores a measure of added area that can be significant for efficient and economical seating of the pads on their associated tone holes.

The pad is held in the flute cup either by adhesive or bonding material, or it may be held in mechanically by securing a washer or bushing with a screw to an anchor or spud formed integrally with the cup. In that case there will be a clearance hole in the back plate to allow the screw to pass through. A shimming area is provided between the back of the back plate and the inside of the cup. This area can be filled with glue, plastic, paper, or any combination of those things or other things to enable the pad to be positioned so that it will seal properly conformed to the opening in the tone hole rim. It is often desirable, though not required, that the cushion be slightly larger in lateral extent than the back plate when a membrane is used to wrap the pad. This allows the membrane to be pulled down against the relatively soft cushion rather than the non-compliant back plate. This minimizes the chance that the membrane will abrade or tear where it is pulled taut at the edge of the back plate.

The diameter or lateral extent of the inner step ring or collar may be the same or slightly less than the diameter of the bushing or washer which will be held against that collar so that a portion of the bushing or washer extends over the cushion to directly hold it in addition to the indirect holding through the securing of the membrane. If the cushion is not adhered to the back plate then the collar should be no higher than the total thickness of the cushion plus the membrane in order for the washer or bushing to prevent the cushion from pulling away from the back plate. However, if the pad is secured in the cup by adhesion rather than mechanical means, then the inner step ring or collar may be made slightly axially higher than the cushion in order to provide enough tension on the membrane to prevent the vibrating column of air inside the flute or other musical instrument from causing the membrane to vibrate and buzz.

The back plate may be made of Delrin and there may be a bevel on the bottom outer edge of the back plate to minimize the chance that the membrane will tear when it is pulled tight against the pad. The cushion may be a synthetic material such as the material sold under the trade name Charisma by C. W. Fifield of Hingham, Mass. Typically the synthetic cushion is placed around the Delrin inner step ring or collar and a commonly available membrane made of "fish skin" (animal intestine) is wrapped around the front of the pad and secured to the back with a mucilage glue such as available from Elmer's or LePage. An optional paper covering may be placed over the glued membrane on the back of the pad. After the glue is dry the membrane which is covering the center hole of the pad is punched out to provide access to the clearance hole.

There is shown in FIG. 1 a pad 10 according to this invention mounted in a cup 12 in position over the tone hole rim 14 of a musical instrument such as flute 16 only a portion of which is shown. Pad 10 includes a back plate 18 and cushion 20. Cup 12 and pad 10 are round, that is, they are generally circularly symmetrical about axis 22 and so generally throughout this specific description of the drawings the directions of axial and radial or diametric will be used rather than lateral and vertical. Back plate 18 includes a generally planar portion 24 extending radially outwardly from axis 22 and a stepped inner ring or collar 26 which extends generally in the direction of axis 22. Cushion 10 nests against portion 24 in collar 26 and extends to near, at or beyond the edge 28 of portion 24. In fact, in FIG. 1, the edge 30 of cushion 20 actually extends beyond the edge 28 of portion 24. This ensures that delicate membrane 32 is protected somewhat from being drawn tightly against the protruding edges of back plate 18. Washer or bushing 34 serves to secure pad 10 in cup 12 by means of screw 36 which extends through clearance hole 38 in pad 10 to threadably engage with spud 40 integrally formed with cup 12. Bushing or washer 34 can be made to extend radially beyond the edge of collar 26 so that its edge 42 actually overlaps the inner portion 44 of cushion 20 so that there is a positive holding action of bushing 34 in addition to the holding action provided through the action of bushing 34 against the membrane 32. As indicated at 33 where membrane 32 is shown in phantom, membrane 32 need not be used. And, in that case, bushing 34 directly engages cushion 20.

Figure 2A:
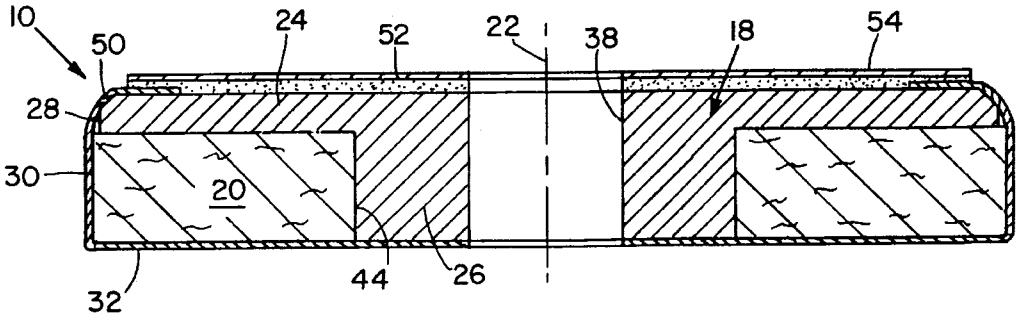
FIG. 2A is an enlarged detail view of the pad of FIG. 1.
Figure 2B:
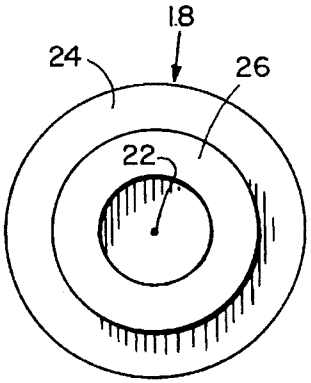
FIG. 2B is a top plan view of the back plate showing the inner stepped ting.

The course of membrane 32 and its attachment can be seen more clearly in FIG. 2A, where the comer of portion 24 has been beveled or chamfered 50 to further reduce the potential for tearing or premature wearing of membrane 32. The typical form of fastening the membrane 32 is also apparent in FIG. 2A, where the glue is applied to the back 52 of back plate 18 and then covered by a paper sheet 54. The circular symmetry of pad 10 can be seen more clearly in FIG. 2B, where a top plan view of just the back plate shows the shape and extent of collar 26 and portion 24. In an alternative embodiment, where it is desirable to increase the tautness of the membrane, back plate **18*a*, FIG. 3, includes generally planar portion 24*a* and inner step or collar 26*a* which is shown rising at edge 60 to a level slightly above cushion 20*a*. Membrane 32*a* is fastened by applying glue to back 52*a* of back plate 18*a* and then covered by paper sheet 54*a*. Rising edge 60 provides an extra measure of stretching of membrane 32*a*** which provides the tightness to prevent the vibrating column of air inside the musical instrument from causing the membrane to buzz.

Figure 3:
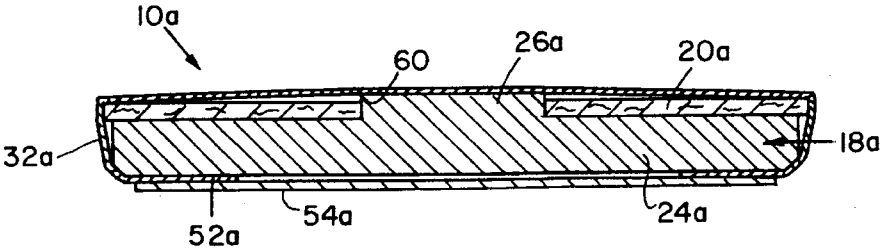
FIG. 3 is a sectional view similar to that of FIG. 2A of an alternative construction for the pad.

Pad **10*a*, FIG. 3**, it should be noted, also does not have a clearance hole as it is meant to be secured in a cup by an adhesive or bonding technique rather than by mechanical fasteners, which is sometimes desirable or preferred. The provision of the stepped ring or collar provides an advantage which carries over whether the pad is fastened by mechanical means or by bonding or adhesive. That is, the rigid or non-compliant nature of the collar permits it to act as a built-in resonator even when the washer or bushing which normally serves as a resonator is absent in the case of the bonded or adhesively mounted pads.

Although specific features of this invention are shown in some drawings and not others, this is for convenience only as each feature may be combined with any or all of the other features in accordance with the invention.

Other embodiments will occur to those skilled in the art and are within the following claims:

What is claimed is:

1. A pad to be mounted in a cup for closing a tone hole in a musical instrument, comprising:

a rigid back plate having a generally planar base and a central raised collar;

a compliant cushion disposed on said back plate and around said collar and extending laterally approximately to the edge of said back plate; said cushion having a first surface engaged with said back plate and a second, opposite surface;

a membrane stretched tautly over said cushion and collar; and said collar rises axially above the second surface of said cushion and contacts said membrane for increasing the tension on said membrane.

2. The pad of claim 1 in which said collar includes a clearance hole for mounting said pad to the cup.

3. The pad of claim 2 in which said pad includes a fastener extending through said clearance hole for engaging said cup.

4. The pad of claim 1 in which said fastener includes a bushing which extends laterally beyond said collar and engages a portion of said cushion.

5. A pad to be mounted in a cup for closing a tone hole in a musical instrument, comprising:

a rigid backplate having a generally planar face and a central raised collar;

a compliant cushion disposed on said backplate and around said collar; said cushion having a first surface engaged with said backplate and a second, opposite surface;

a membrane stretched tautly over said cushion and collar; and said collar rising above the second surface of said cushion and contacting said membrane for increasing the tension on said membrane.

6. The pad of claim 5 in which said collar includes a clearance hole for mounting said pad to the cup.

7. The pad of claim 6 in which said pad includes a fastener receivable in said clearance hole.

8. The pad of claim 7 in which said fastener includes a bushing which extends laterally beyond said collar and engages a portion of said cushion.

* * * * *